United States Patent [19]

Akinaga

[11] Patent Number: 4,653,294

[45] Date of Patent: Mar. 31, 1987

[54] WASHING MACHINE

[75] Inventor: Norimasa Akinaga, Yao, Japan

[73] Assignee: Sharp Kabushiki Kaisha, Osaka, Japan

[21] Appl. No.: 790,317

[22] Filed: Oct. 23, 1985

[30] Foreign Application Priority Data

Dec. 28, 1984 [JP] Japan ..... 59-280979
Dec. 28, 1984 [JP] Japan ..... 59-280980

[51] Int. Cl.[4] ..... D06F 33/02; D06F 39/00
[52] U.S. Cl. ..... 68/12 R; 68/207
[58] Field of Search ..... 68/12 R, 13 R, 207; 134/57 D, 113; 356/433–436, 440–442

[56] References Cited

U.S. PATENT DOCUMENTS 3,613,405 10/1971 Shimokusu et al. ..... 68/12 R

FOREIGN PATENT DOCUMENTS 115095 7/1984 Japan ..... 68/13 R
211490 11/1984 Japan ..... 68/13 R

*Primary Examiner*—Philip R. Coe
*Attorney, Agent, or Firm*—Flehr, Hohbach, Test, Albritton & Herbert

[57] ABSTRACT

A washing machine of the type having an optical detector to measure the transparency of liquid therein to control its washing and rinsing operations includes a water valve through which fresh water is supplied to the detector directly without passing through its wash tank. Fresh water thus supplied directly to the detector is used to clean its windows and/or to enable the transparency of fresh water to be correctly measured as a reference value. A separate valve is used for supplying water to the wash tank.

4 Claims, 5 Drawing Figures

WASHING MACHINE

This invention relates to a washing machine which controls its washing and rinsing operations by optically detecting the transparency of cleaning liquid and the time rate of its change.

Many types of automatic washing machines have been developed which control their washing and rinsing operations by optically detecting the change in transparency in cleaning liquid. It goes without saying that the windows in the detector section must be perfectly clean when the transparency of cleaning liquid is optically measured. If the washing machine is of a type which controls its rinsing operation on the basis of the relative difference in transparency between fresh water and cleaning liquid, it is also necessary to accurately measure the transparency of fresh water in order to improve the accuracy of the control. When fresh water is supplied prior to a rinsing operation, however, the supplied fresh water reaches the detector section by passing through the interior of the tank. In other words, fresh water becomes mixed with the detergent and dirt particles which may have come to be attached to the tank and remain there after the draining operation and this means that the transparency of fresh water is not being measured correctly.

It is therefore one of the objects of the present invention to provide a washing machine with an optical detector, the windows of which can be maintained clean.

Another object of the present invention is to provide a washing machine with improved accuracy of control over its rinsing operations by correctly measuring the transparency of fresh water as a reference value.

The above and other objects of the present invention are achieved by providing a washing machine of the type which comprises not only an optical detector to measure the transparency of liquid therein to control its operations such as washing and rinsing but also a valve through which fresh water is directly supplied to the detector without passing through the wash tank into which water is supplied through another valve.

The accompanying drawings, which are incorporated in and form a part of the specification, illustrate embodiments of the present invention and, together with the description, serve to explain the principles of the invention.

Figure 1:
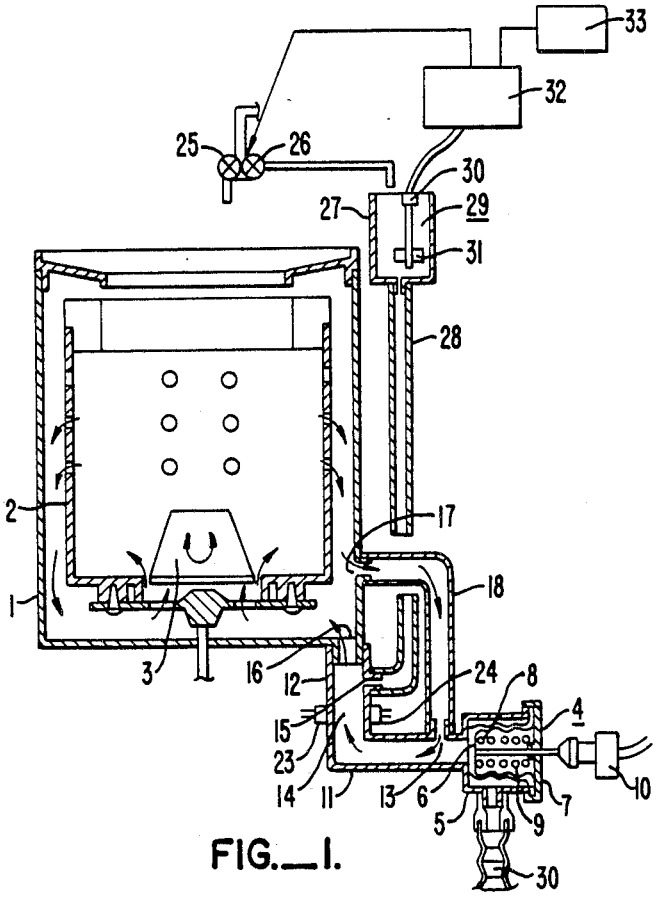
FIG. 1 is a schematic cross-sectional view of the principal part of a washing machine embodying the present invention.

FIG. 1 is a schematic cross-sectional view of the principal part of a washing machine embodying the present invention and shows a water tank 1, a rotary wash and drain tank 2, a pulsator 3, and a drain valve 4 having a casing 5 with an opening section 6 which can be closed, a member 8 for opening and closing the opening section 6, a spring 9 adapted to bias the member 8 in the direction of keeping the opening section 6 closed all the time, and a solenoid 10 for moving the member 8. The valve casing 5 may be made of a synthetic resin material and formed as a unitized structure with a pipe section 11 connected at the opening section 6. This pipe section 11 has connection openings 12 and 13 near the top and the opening section 6 and a detector 14 therebetween. There is also a side connection opening 15 between the detector 14 and the top connection opening 12. The drain valve 4 is connected to the water tank 1 by joining the aforementioned top connection opening 12 directly with a drain hole 16 at the bottom of the water tank 1 and the other connection opening 13 through a tube 18 to a circulation opening 17 on the bottom side wall of the water tank 1.

Figure 2:
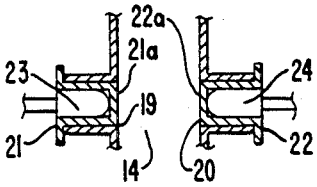
FIG. 2 is an enlarged cross-sectional view of the detector of FIG. 1.

FIG. 2 is an enlarged cross-sectional view of the detector 14 comprising a pair of attachment indents 19 and 20 facing each other and tightly closed by transparent covers 21 and 22. Windows **21*a* and 22*a* are provided where the transparent covers 21 and 22 face each other. Numeral 23 indicates a light source (infrared light-emitting diode) pressure-mounted against the transparent cover 21 and numeral 24 indicates a light-receiving element (phototransistor) pressure-mounted against the transparent cover 22**.

Reference being made again to FIG. 1, numerals 25 and 26 represent a pair of magnetic valves which may be connected, for example, to a water faucet, one of them (25 in FIG. 1) being adapted to control the supply of water into the water tank 1 and the other (26 in FIG. 1) to control the supply of water to the detector 14. Numeral 27 indicates a container for receiving water supplied through the valve 26 and it is connected to the side connection opening 15 through a hose 28 in such a way that the valve 26, the container 27 and the hose 28 comprise a means for supplying fresh water directly to the detector 14. The container 27 is provided with a water level detector 29 including a guide axis 30 containing a lead switch and a float 31 which contains a magnet inside and moves up and down according to the change in the water level inside the container 27. The lead switch is adapted to normally remain in the ON condition and to change to the OFF condition by the magnet when the water level reaches a predetermined height. Numeral 32 indicates a valve control means which is adapted to control the water supply valves 25 and 26 according to commands from a program control means 33 and serves to forcibly close the valve 26 when the lead switch changes to the OFF condition.

Figure 3:
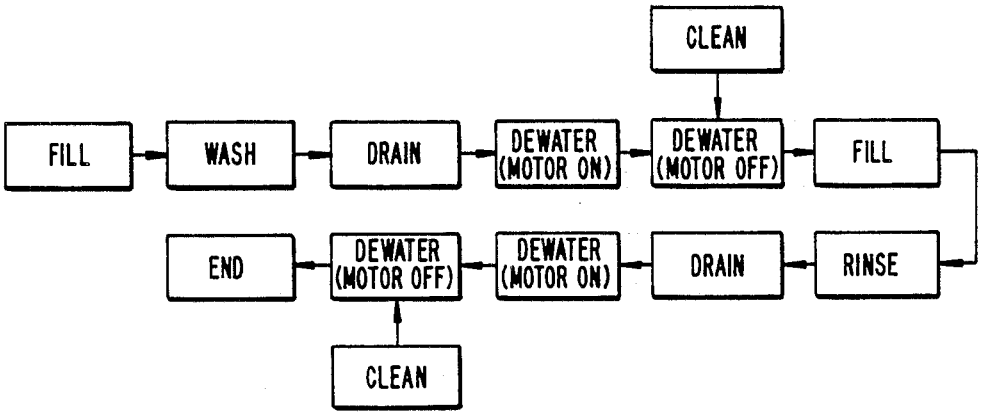
FIG. 3 is a chart for the operation of the washing machine of FIG. 1.

FIG. 3 is a chart for the operation of the washing machine described above, including steps of supplying water, washing, draining, dewatering (spin-drying) and rinsing which are executed according to a prepared program as in the case of conventional washing machines. As will be explained more in detail later, however, the washing and rinsing operations are controlled by measuring the change in the transparency of cleaning liquid. Each of the dewatering steps is divided into a first period and a second period. During the first period, dewatering is effected with the rotary tank 2 rotated by a motor (not shown) while the power to the motor is shut off during the second period and dewatering is effected by the inertial rotation of the rotary tank 2. The detector 14 is programmed to be washed only during the aforementioned second period characterized by the inertial rotation of the rotary tank 2. In other words, the valve 26 is activated and opened simultaneously as the power to the motor for the rotary tank 2 is cut off.

During the washing and rinsing operations, the pulsator 3 is rotated so that the cleaning liquid inside the tank 1 circulates both inside and outside of the rotary tank 2 through the holes of the rotary tank 2. A portion of this water is adapted to circulate through the circulation opening 17, the tube 18, the pipe section 11 which includes the detector 14 and the drain hole 16. Changes in the transparency of liquid flowing inside the detector 14 are measured by means of the light source 23 and the light-receiving element 24 to control the washing and rinsing operations.

Figure 4:
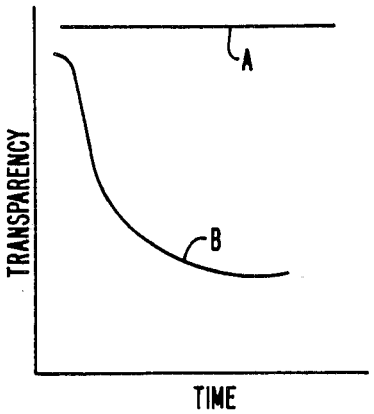
FIG. 4 is a graph which schematically shows the change in transparency of cleaning liquid during a washing operation.

FIG. 4 is a graph which schematically shows the change in transparency of cleaning liquid during a washing operation, the lines A and B respectively indicating the transparency of fresh water and cleaning liquid. During a washing operation, the transparency of cleaning liquid decreases because of the dirt particles from the articles being washed, etc. When the change in transparency becomes minimal, the washing operation is terminated and the next step of draining operation is started.

Figure 5:
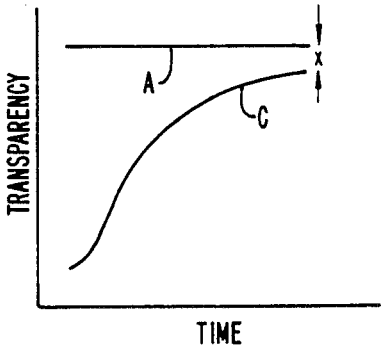
FIG. 5 is a graph which schematically shows the change in transparency of cleaning liquid during a rinsing operation.

FIG. 5 is a graph which schematically shows the change in transparency of cleaning liquid during a rinsing operation, the lines A and C respectively indicating the transparency of fresh water and cleaning liquid. During a rinsing operation, the transparency of cleaning liquid increases and the dirt becomes gradually diluted. The rinsing operation is terminated when the change in the transparency of cleaning liquid becomes minimal and its relative difference from the transparency of fresh water reaches a predetermined magnitude x (as shown in FIG. 5) or the transparency has recovered to a predetermined target level.

At the beginning of a rinsing operation, the valve 26 is opened before the valve 25 is activated so as to send fresh water through the container 27 and the hose 28 to the interior of the detector 14. This means that fresh water which has not passed through the interior of the water tank 1 comes to the detector 14. After a predetermined period of time, the valve 26 is closed and the valve 25 is opened to supply water into the water tank 1. The purpose of this program is to enable the transparency of fresh water to be correctly measured at the beginning of a rinsing operation so that its measured value can be stored as a reliable reference level.

To clean the windows 21*a* and 22*a* of the detector 14, the valve 26 is opened at the beginning of the aforementioned second dewatering period (by inertial rotation of the rotary tank 2 with the motor switched off). Fresh water is similarly caused to flow through the hose 28 to the interior of the detector 14 and wash off the dirt particles attached to the windows 21*a* and 22*a*. During this period, since the rotary tank 2 is inertially rotating, each component of the washing machine including the detector 14 is undergoing fine vibrations. Such vibrations are transmitted to the supplied fresh water and this enhances its cleaning effectiveness significantly as compared to the case where water is made to flow down quietly on the window surfaces. Thus, the windows 21*a* and 22*a* are always kept clean so that their transparency remains constant and the changes in the transparency of cleaning liquid can be accurately measured during washing and rinsing operations.

During such a cleaning operation, if the hose 28 becomes clogged for whatever reason and the water level inside the container 27 rises abnormally, the water level detector 29 is activated and the valve 26 is closed to prevent water from overflowing at the top of the container 27.

The foregoing description of a preferred embodiment of the invention has been presented for purposes of illustration and description. It is not intended to be exhaustive or to limit the invention to the precise form disclosed, and obviously many modifications and variations are possible in light of the above teaching. For example, the cleaning of the detector 14 need not be effected exclusively during the second half of a dewatering process. The water level detector 29 need not be exactly of the structure described above, and may be replaced by any means capable of closing the valve 26 by detecting a change in the water level. The embodiment was chosen and described in order to best explain the principles of the invention and its practical application to thereby enable others skilled in the art to best utilize the invention in various embodiments and with various modifications as are suited to the particular use contemplated.

What is claimed is:

1. In a washing machine having a detector which is connected to a water tank so that cleaning liquid is adapted to flow therethrough and/or is adapted to control washing and rinsing operations by a light-emitting and a photosensitive element, a water container connected to said detector through a hose, and a water supply valve serving to control water supply into said container and to supply fresh water into said detector through said water container and said hose, and a water level detector serving to monitor the variations in the water level inside said container and to close said supply valve when a specified water level has been reached inside said container.

2. The washing machine of claim 1 wherein said supply valve is programmed to be opened during an inertial dewatering process of said washing machine.

3. In a washing machine having a detector which is connected to a water tank so that a cleaning liquid is adapted to flow therethrough and is adapted to control rinsing operation by detecting the temporal rate of change in transparency of cleaning liquid in said detector by means of a combination of a light source and a light-receiving element, a first water-supplying means for supplying water into said water tank, and a second water-supplying means for supplying water directly into said detector without passing through said water tank, said second water-supplying means being adapted to be operated before said first water-supplying means.

4. The washing machine of claim 3 wherein said second water-supplying means is programmed to be opened prior to a rinsing operation of said washing machine.

* * * * *